US006091333A

United States Patent [19]

Oshima

[11] Patent Number: 6,091,333

[45] Date of Patent: Jul. 18, 2000

[54] SHOPLIFTING PREVENTION DEVICE AND ARTICLE WITH SHOPLIFTING PREVENTION DEVICE

[75] Inventor: Hiroyasu Oshima, Ishikawa, Japan

[73] Assignee: Wovenac Factory Inc., Japan

[21] Appl. No.: 09/272,308

[22] Filed: Mar. 19, 1999

[30] Foreign Application Priority Data

Mar. 20, 1998 [JP] Japan ..... 10-114049

[51] Int. Cl.[7] ..... G08B 13/14

[52] U.S. Cl. ..... 340/572.1; 340/568.1; 340/571; 340/572.8; 281/15.1

[58] Field of Search ..... 340/551, 571, 340/572.1, 572.3, 572.5, 572.6, 572.8, 568.1, 572.7, 825.34, 825.31, 825.54; 281/15.1, 51; 428/251, 259; 235/488, 493; 252/511, 512

[56] References Cited

U.S. PATENT DOCUMENTS

| | | | |
|---|---|---|---|
| 4,260,881 | 4/1981 | Peterson | 235/493 |
| 5,290,066 | 3/1994 | Mody | 281/15.1 |
| 5,306,552 | 4/1994 | Shimizu | 340/551 |
| 5,622,652 | 4/1997 | Kucherovsky et al. | 252/511 |
| 5,627,562 | 5/1997 | Skodlar | 235/493 |
| 5,660,663 | 8/1997 | Chamberlain et al. | 156/152 |
| 5,816,620 | 10/1998 | Buell | 283/74 |
| 5,896,087 | 4/1999 | Frowein | 340/572.1 |

FOREIGN PATENT DOCUMENTS

| | | |
|---|---|---|
| 1-106199 | 4/1989 | Japan . |
| 1-214712 | 8/1989 | Japan . |
| 6-93564 | 4/1994 | Japan . |
| 9-92519 | 4/1997 | Japan . |
| 9-147251 | 6/1997 | Japan . |

*Primary Examiner*—Daniel J. Wu
*Assistant Examiner*—Van T. Tried
*Attorney, Agent, or Firm*—Rader, Fishman & Grauer

[57] ABSTRACT

A shoplifting prevention device is provided which includes a marker that carries merchandise identifying information thereon, and a magnetic recording medium that is combined with the marker, and can be magnetized and demagnetized to permit recording and erasing of information by means of a magnetic field. The shoplifting prevention device is attached to an article of merchandise. In one preferred form of the invention, the marker consists of a cloth that carries merchandise identifying information, and the device including the cloth combined with the magnetic recording medium is attached to an article.

9 Claims, 4 Drawing Sheets

SHOPLIFTING PREVENTION DEVICE AND ARTICLE WITH SHOPLIFTING PREVENTION DEVICE

FIELD OF THE INVENTION

The present invention relates to shoplifting prevention devices for preventing shoplifting or other improper taking-out of various kinds of goods, such as garments, bags, shoes, umbrellas, and other general goods, and also relates to articles to which such devices are attached so as to prevent shoplifting of the articles.

BACKGROUND OF THE INVENTION

In many shops, boutiques, shopping centers, and rental shops and libraries storing recorded video tapes, compact discs and records, shoplifting detecting systems have been installed so as to prevent shoplifting or other improper taking-out of merchandise, or software and books to be lent out. The shoplifting detecting systems are roughly classified into those of radio-wave type, and those of magnetic type. As a magnetic-type device for preventing shoplifting or other improper taking-out of books, for example, a strip-like magnetic sensor sheet S including a coder that has been demagnetized is attached to a book B as shown in FIG. 14. Upon purchase or renting, the book B is placed on a writer D so that a magnetic effect is given to the coder, thereby to suppress the function of a transponder of the magnetic sensor sheet S. If the customer properly finishes processing of transaction for the book Ba at a checkout resister or lending section where the magnetic effect is given to the coder of the magnetic sensor sheet S, an alarm system Aa does not go off when the customer carrying the book Ba passes through a detection gate G installed at the entrance of the shop. If the customer improperly takes out the book Bb without going through the checkout register or lending section, the detection gate G senses the transponder of the magnetic sensor sheet S when the customer passes through the gate G, and the alarm system Ab emits light or sound to thus generate an alarm.

Although the size of the magnetic sensor sheet S as a known shoplifting prevention device has been reduced, customers can still easily recognize the presence of the magnetic sensor sheet S, and there is a possibility that the sensor sheet S is easily removed and thrown away on purpose. Further, the cost of processing and attaching the shoplifting prevention device tends to be high since separate components or markers used for preventing shoplifting must be attached to individual items of merchandise. Also, the appearance of the goods is likely to deteriorate due to the presence of such devices.

SUMMARY OF THE INVENTION

The present invention was developed based on the known shoplifting prevention method of magnetic type. The object of the invention is to prevent the shoplifting prevention device from being easily removed, and reduce the labor and cost for attaching the shoplifting prevention devices to individual articles, while avoiding deterioration of the appearance or touch of the articles even if the shoplifting prevention devices are attached to the articles.

According to the present invention, a device for preventing shoplifting of merchandise is attached to a portion of an article that is essential when it is sold, more particularly, a marker that carries information that identifies the article (such as trademark, commodity symbol, model number, manufacturer, or indication of materials and washing instructions), which information is particularly important to brand-name items, popular items, and quality items. Also, such items as garments, bags, shoes and umbrellas, and other general goods, are required to provide soft touch or flexibility, and therefore merchandise identification labels made of cloths are often used as the markers carrying merchandise identifying information. The shoplifting prevention device of the present invention is incorporated into or combined with such a merchandise identification label made of a cloth.

The above-described markers may be made of a soft material with high flexibility, or may be a hard material that is difficult to deform, depending upon an item to which the marker is attached. Also, the marker may be in the form of a sheet, or a block, or other shapes. Sheet-like markers include films, unwoven fabrics, and cloths. The markers as described above may be called brand (or trademark, or name) tags, labels, sheets, or ribbons.

To accomplish the above object, the present invention provides a shoplifting prevention device, comprising a marker that carries merchandise identifying information thereon, and a magnetic recording medium that is combined with the marker and can be magnetized and demagnetized to permit magnetic recording and erasing. The present invention also provides a shoplifting prevention device, comprising a cloth that carries merchandise identifying information thereon, and a magnetic recording medium that is combined with the cloth and can be magnetized and demagnetized to enable magnetic recording and erasing. The present invention further provides a shoplifting prevention device, comprising a cloth that carries merchandise identifying information thereon, and a magnetic recording medium that is woven into the cloth, and can be magnetized and demagnetized to permit magnetic recording and erasing.

According to another aspect of the invention, there is provided an article with a shoplifting prevention device, which includes a marker that carries merchandise identifying information thereon, and a magnetic recording medium that is combined with the marker and can be magnetized and demagnetized to permit magnetic recording and erasing. The present invention also provides an article with a shoplifting prevention device, which includes a cloth that carries merchandise identifying information thereon, and a magnetic recording medium that is combined with the cloth and can be magnetized and demagnetized for recording and erasing of magnetic information. The present invention further provides an article with a shoplifting prevention device, comprising a cloth that carries merchandise identifying information thereon, and a magnetic recording medium that is woven into the cloth, and can be selectively magnetized and demagnetized for recording and erasing of magnetic information.

BRIEF DESCRIPTION OF THE DRAWINGS

The invention will be described in greater detail with reference to preferred embodiments thereof and the accompanying drawings, wherein.

DETAILED DESCRIPTION OF THE PREFERRED EMBODIMENTS

Embodiments of the present invention will be described in detail, with reference to the drawings showing some articles of merchandise provided with shoplifting prevention devices in the form of markers, and some examples of the shoplifting prevention devices.

Figure 10:
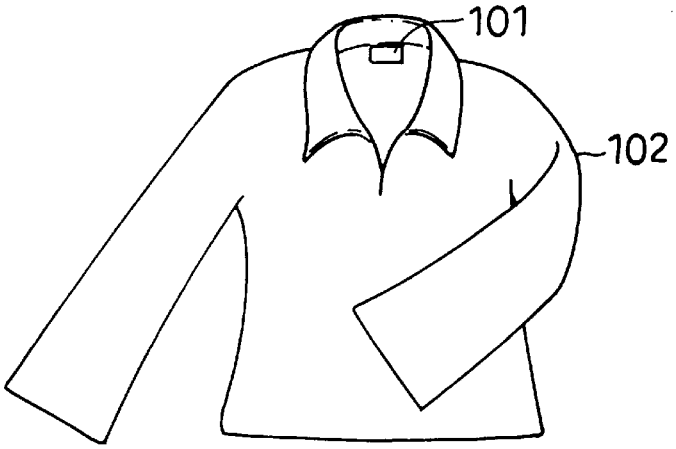
FIG. 10 is a perspective view showing a shirt to which a shoplifting prevention label of the present invention is attached.
Figure 11:
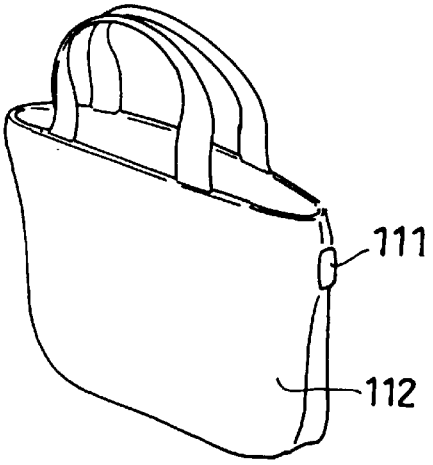
FIG. 11 is a perspective view showing a bag to which a shoplifting prevention label of the present invention is attached.
Figure 12:
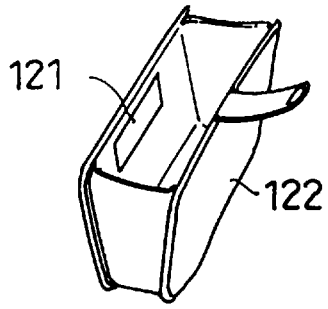
FIG. 12 is a perspective view showing a briefcase to which a shoplifting prevention label of the present invention is attached.
Figure 13:
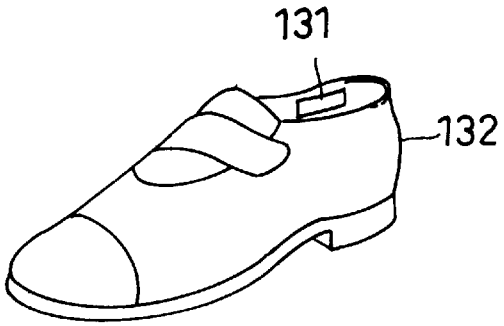
FIG. 13 is a perspective view showing a shoe to which a shoplifting prevention label of the present invention is attached.
Figure 14:
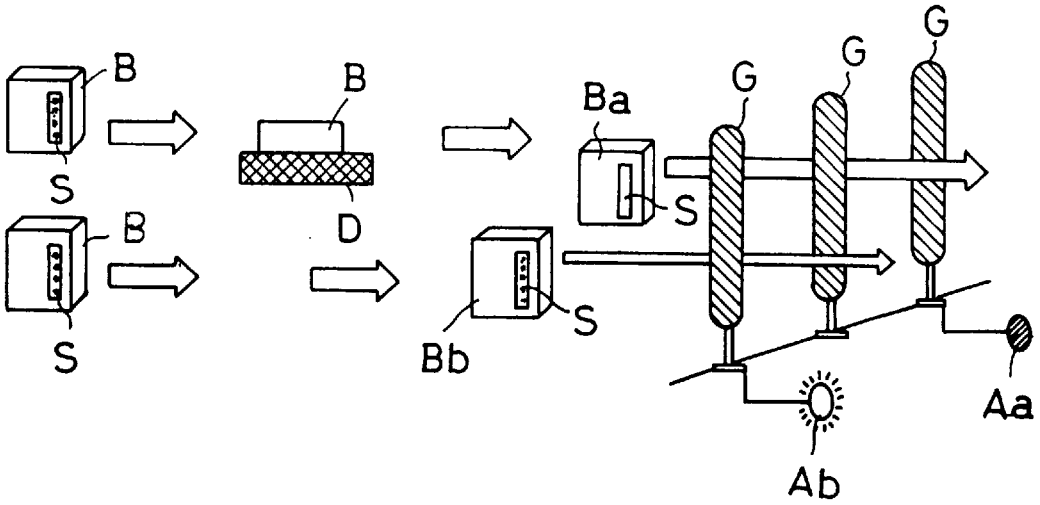
FIG. 14 is a view useful in explaining a known magnetic-type method for preventing shoplifting of merchandise.

FIG. 10 through FIG. 13 are perspective views showing articles provided with shoplifting prevention devices as one embodiment of the present invention. FIG. 10 shows a shirt 102 to which a shoplifting prevention label 101 to be detected by a sensor is attached. FIG. 11 shows a bag 112 to which a shoplifting prevention label 111 is attached. FIG. 12 shows a briefcase 122 to which a shoplifting prevention label 121 is attached. FIG. 13 shows a shoe 132 to which a shoplifting prevention label 131 is attached. The shoplifting prevention labels (hereinafter simply referred to as labels) 101, 111, 121, 131 carry or bear information, such as the trademark, trade name, commodity symbol, and model number, that identifies each item of merchandise. Although the appearances of these labels are almost the same as those of so-called brand labels, magnetic media for preventing shoplifting of merchandise are incorporated into the brand labels. The label 121 attached to the briefcase 122 made of a relatively hard material is formed from a thick, hard, sheet-like material that is hard to bend, whereas the labels 101, 111, and 131 attached to such items as shirt 102, bag 112, and shoes 132 are formed from thin, flexible sheets, in particular, cloths, so as to provide sufficient softness and be pleasing to the touch. The shoplifting prevention markers are not limited to sheet-like labels, but may be in the form of blocks, depending upon the kind of articles.

The construction of one example of shoplifting prevention marker will be now described. The shoplifting prevention marker consists of a transponder that uses a metallic wire having a diameter of about 100 $\mu$m and a length of about 50 mm and showing a Barkhausen effect, and a several-mm-size coder adhered to the transponder and formed of a metal having a large remanent magnetization. When the coder is magnetized by a writer, the transponder holds magnetic force in a saturated region that does not show the Barkhausen effect, so that information "0" is stored in that region. When the coder is demagnetized by the writer, on the other hand, the transponder returns to a region that shows the Barkhausen effect, so that information "1" is stored. The information "1" means that processing of transaction for the relevant item of merchandise has not been completed.

Figure 1:
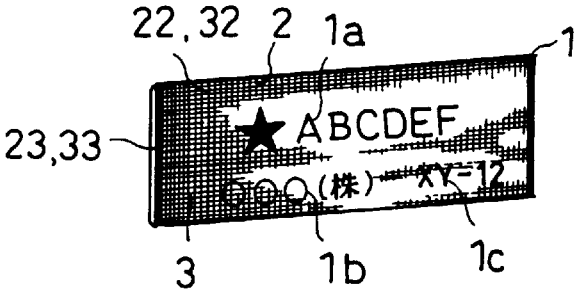
FIG. 1 is a perspective view showing the front face of a shoplifting prevention label according to one embodiment of the present invention.
Figure 2:
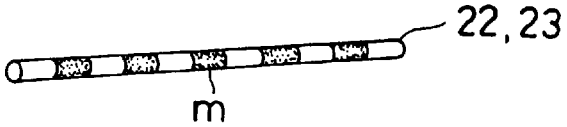
FIG. 2 is an enlarged, perspective view showing a magnetizable thread of warp or weft of the shoplifting prevention label of FIG. 1.
Figure 3:
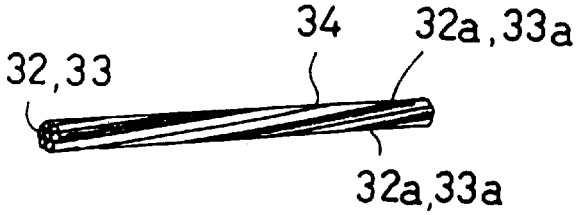
FIG. 3 is an enlarged, perspective view showing another example of a magnetizable thread of warp or weft of the shoplifting prevention label of FIG. 1.

FIG. 1 shows one embodiment of a shoplifting prevention marker of the present invention. In FIG. 1, reference numeral 1 denotes a label in the form of a piece of cloth, whose surface carries merchandise identifying information, such as trademark 1*a*, trade name 1*b*, commodity number and model number 1*c*, relating to the article to which the label 1 is attached. Thus, the label 1 primarily functions as a brand label. As shown in FIG. 2 and FIG. 3, a magnetic thread 22 or 32 (as part of warp) or magnetic thread 23 or 33 (as part of weft) that serves as a magnetic medium for detecting shoplifting is woven into at least one string of a set or sets of yarns that provide the warp 2 and weft 3 of the fabric label 1. The magnetic threads 22, 32 or magnetic threads 23, 33 may be woven into only one set of yarns that provide the weft 2 or warp 3, or the magnetic threads 22, 32 and magnetic threads 23, 33 may be woven into both sets of yarns that provide the weft 2 and warp 3, depending upon the detecting sensitivity and accuracy of the shoplifting prevention system. Namely, the magnetic threads 22, 32, 23, 33 for preventing shoplifting may be suitably selected so as to ensure sufficiently high detecting sensitivity and accuracy.

FIG. 2 is an enlarged, perspective view of the above-described magnetic thread 22, 23 which consists of a piece of magnetic metallic wire that provides a transponder, which allows a coder adhered to the transponder to be magnetized (as schematically indicated by symbol "m" in FIG. 2), or demagnetized. Namely, the magnetic force is selectively applied to or removed from the coder placed on the transponder. FIG. 3 is an enlarged, perspective view of another example of magnetic thread as described above, namely, magnetic thread 32 or 33 used as part of the warp 2 or weft 3 and having a twisted-yarn structure in which a plurality of yarns or filaments including metallic wires are twisted into a thread. The rest of the warps 2 and wefts are non-magnetizable material. Namely, a plurality of magnetic metallic wires 32*a*, 33*a* are mixed and twisted into threads 34 that constitute a part of the warp 2 or weft 3, so as to form the magnetic threads 32 or 33 used as the warp 2 or weft 3. The coder adhered to the magnetic threads 32, 33 can be freely magnetized or demagnetized.

Various types of film-like or strip-like magnetic threads 22, 23, 32, 33 having the structure of magnetic wires (or twisted structure of magnetic metallic wires) as shown in FIG. 2 or FIG. 3 may be used.

Figure 4:
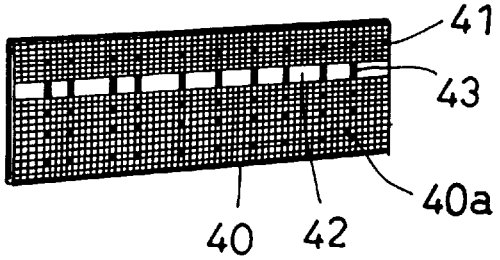
FIG. 4 is a perspective view showing the rear surface of a shoplifting prevention label according to another embodiment of the present invention.

FIG. 4 shows another embodiment of a shoplifting prevention marker of the present invention. In this embodiment, a transponder and a coder 42 in the form of a tape or string is provided on the rear side 40*a* of a fabric brand label 40 that bears merchandise identifying information on its front surface, and the transponder and coder 42 is woven into the brand label 40 by means of threads 43 as part of the warp, to thus provide a label (shoplifting prevention device) 41.

Figure 5:
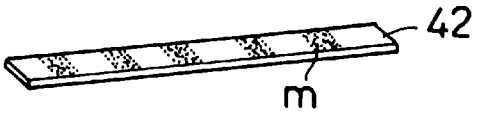
FIG. 5 is an enlarged, perspective view showing one example of magnetic recording medium of the shoplifting prevention label of FIG. 4.
Figure 6:
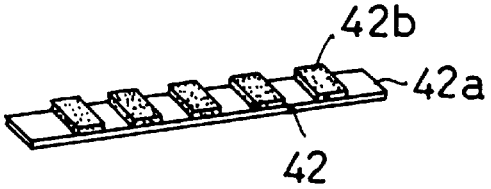
FIG. 6 is an enlarged, perspective view showing another example of magnetic recording medium of the shoplifting prevention label of FIG. 4.

The transponder and coder 42 consisting of a tape-like transponder 42*a*, and a chip-like coder 42*b*, as shown in FIG. 5 and FIG. 6, and the coder 42*b* can be selectively magnetized (in FIG. 5, magnetized portions are indicated by "m") or demagnetized, to thus permit magnetic recording and erasing by means of a magnetic field. As shown in FIG. 6, the magnetic recording medium 42 may be formed by depositing the coder 42*b* of Fe—Cr system having a large coercive force, onto the transponder 42*b* of Fe—Si—B system that has a Barkhausen effect.

Figure 7:
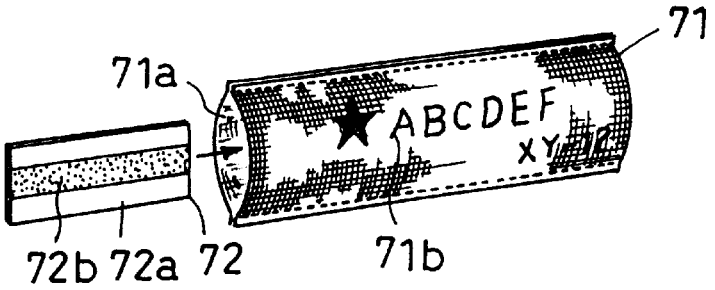
FIG. 7 is an exploded, perspective view showing a shoplifting prevention label according to a further embodiment of the present invention.

FIG. 7 shows a further embodiment of a shoplifting prevention marker of the present invention. In this embodiment, a fabric label (marker) 71 is formed by superposing two layers of cloth into a small bag or bottomless cylindrical shape, and inserting a transponder and a coder 72 into a clearance 71*a* between the two layers. Merchandise identifying information 71*b* is provided on the outer surface of the label 71. The transponder and coder 72*b* is attached to a substrate 72*a* having certain flexibility. The substrate 72*a* may or may not be flexible depending upon the kind of an article to which the label 71 is to be attached. As another example, the cloth that forms the label 71 may be folded twice or more times, to provide a multi-layer structure, and magnetic transponder and coder 72 may be inserted into a plurality of clearances between the layers. Also, the label may be formed from other types of sheets in place of fabric sheets.

Figure 8:
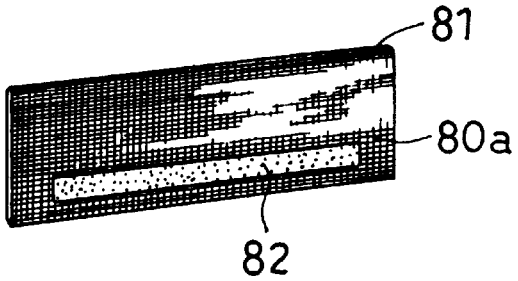
FIG. 8 is a perspective view showing the rear surface of a shoplifting prevention label according to a still further embodiment of the present invention.

FIG. 8 shows a simple embodiment of a shoplifting prevention marker of the present invention. In this embodiment, a transponder and a coder 82 that can be magnetized or demagnetized for magnetic recording or erasing is bonded to the rear side 80*a* of a fabric brand label 81 that bears merchandise identifying information on its front surface.

Figure 9:
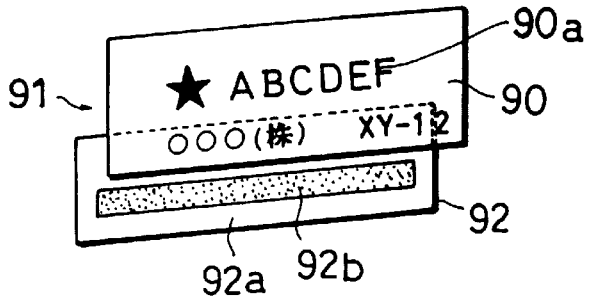
FIG. 9 is an exploded, perspective view of a shoplifting prevention label according to another embodiment of the present invention.

FIG. 9 shows a still further embodiment of a shoplifting prevention marker of the present invention, in which a transponder and coder 92 is bonded to the rear surface of a plastic brand sheet 90 having merchandise identifying information, such as a trademark 90*a*, on its front surface, so as to provide a shoplifting prevention sheet (marker). The transponder and coder 92*b* is bonded or attached onto a substrate 92*a*.

For general items of merchandise to be sold at shops, except those to be lent out for a certain period, the shoplifting prevention marker as described above is required to perform its function only while the relevant item is being placed in a shop for sale. Once the item is sold to a customer, the marker is no longer needed. Accordingly, the shoplifting prevention label 81 or sheet 91 as shown in FIG. 8 and FIG. 9 may use an adhesive having a suitably adjusted bonding force, or the substrate 92*a* may be formed of a water-soluble material (such as water soluble filament yarn "SOLVRON" (trade name of Nitivy Company, Ltd.) that is commercially available), so that the bonding of the label 81 or transponder and coder 92 is released, or the substrate 92*a* is dissolved and removed, when the label 81 or sheet 91 is put in water for a short period of time, for example at least 5 seconds, when the clothes to which the sheet 91 is attached is washed with warm water. Such a sheet or label that is dissolved after being immersed in water for 5 seconds is commercially available from Nitivy Company, Ltd. In this case, the shoplifting prevent label 81 or transponder and coder 92 needs to be kept bonded for a certain minimum period of time (short time), or the substrate 92*a* is kept from being dissolved for the minimum period of time, even if the shoplifting prevention label 81 or detection sheet 91 is put in water. Since the garments are generally subjected to a steam press process after sewing, the bonding force needs to be retained, or the substrate 92*a* should not be dissolved, during a short time in which the label 81 or sheet 91 is exposed to steam during the press. In view of the process step, the minimum period of time may be set to about five seconds.

As is apparent from the illustrated embodiments, the function of preventing shoplifting of merchandise is added to a marker, such as a brand label or brand tag, that carries merchandise identifying information and is necessarily attached to each item, to thus provide an article with a shoplifting prevention device according to the present invention. Accordingly, separate or exclusive devices for preventing shoplifting need not be attached to individual items of merchandise, and the cost for attaching the device to each item can be reduced, which may cause shoplifting prevention devices to be widespread in the public. Since the marker that carriers merchandise identifying information is an important part of the article, not only for brand-name items, popular items and quality items, but also for general goods, the marker cannot be easily removed, and therefore the shoplifting prevention device that is an integral part of the marker with identifying information is unlikely to be easily removed and thrown away.

While cloths are widely used as a material of markers carrying merchandise identifying information, the transponder and coder for protecting merchandise against shoplifting is formed into threads, which are then woven into the fabric marker to provide the warp or weft. Thus, the shoplifting prevention marker is not very noticeable nor does it detract from the touch or feel of the article to which the marker is attached, and it conforms to the shape of the article.

The disclosure of Japanese Patent Application No. 10-114049 filed Mar. 20, 1998, including specification, drawings and claims is incorporated herein by reference in its entirety.

Although some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A shoplifting prevention device comprising:

a marker that carries merchandise identifying information thereon; and a magnetic recording medium that can be magnetized and demagnetized to permit magnetic recording and erasing, said magnetic recording medium being combined with said marker;

wherein said magnetic recording medium separates from said marker upon immersion in water for at least a predetermined period of time.

2. A shoplifting prevention device according to claim 1, wherein said marker being a flexible sheet, and said magnetic recording medium being combined with said flexible sheet.

3. A shoplifting prevention device according to claim 2, wherein said magnetic recording medium being provided on a rear surface of said sheet.

4. A shoplifting prevention device according to claim 1, wherein said marker being a cloth and said magnetic recording medium being combined with said cloth.

5. A shoplifting prevention device according to claim 4, wherein said magnetic recording medium being provided on a rear surface of said cloth.

6. A shoplifting prevention device according to claim 1, said device further comprises a substrate, wherein said substrate is bonded to said marker and said magnetic recording medium is attached to said substrate.

7. A shoplifting prevention device according to claim 6, wherein the bond between said substrate and said marker is water soluble.

8. A shoplifting prevention device according to claim 7, wherein said substrate is released from said marker by putting the substrate in water for at least 5 seconds.

9. An article comprising a shoplifting prevention device according to claim 1.

* * * * *